US009764441B2

(12) United States Patent
Monnoyeur

(10) Patent No.: US 9,764,441 B2
(45) Date of Patent: Sep. 19, 2017

(54) DEVICE FOR POLISHING OPTICAL LENSES

(71) Applicant: VISIOPTIMUM INTERNATIONAL, Lons-le-Saunier (FR)

(72) Inventor: Guy Monnoyeur, Songeson (FR)

(73) Assignee: VISIOPTIMUM INTERNATIONAL, Lons-le-Saunier (FR)

( * ) Notice: Subject to any disclaimer, the term of this patent is extended or adjusted under 35 U.S.C. 154(b) by 285 days.

(21) Appl. No.: 14/347,620

(22) PCT Filed: Sep. 21, 2012

(86) PCT No.: PCT/FR2012/052108
§ 371 (c)(1),
(2) Date: Mar. 26, 2014

(87) PCT Pub. No.: WO2013/045795
PCT Pub. Date: Apr. 4, 2013

(65) Prior Publication Data

US 2014/0235142 A1 Aug. 21, 2014

(30) Foreign Application Priority Data

Sep. 27, 2011 (FR) ..... 11 58600

(51) Int. Cl.
*B24B 13/00* (2006.01)
*B24B 13/01* (2006.01)
(Continued)

(52) U.S. Cl.
CPC ..... *B24B 13/012* (2013.01); *B24B 13/00* (2013.01); *B24B 13/02* (2013.01); *B24B 13/06* (2013.01); *B24B 49/16* (2013.01)

(58) Field of Classification Search
CPC ..... B24B 13/00; B24B 13/012; B24B 13/02; B24B 13/06; B24B 41/04; B24B 41/047; B24B 49/16
See application file for complete search history.

(56) References Cited

U.S. PATENT DOCUMENTS 2,352,146 A * 6/1944 Desenberg ..... B24B 13/02 125/11.03
2,371,303 A 3/1945 Leibowitz
(Continued)

FOREIGN PATENT DOCUMENTS

DE 10248104 A1 5/2003
EP 0043233 A1 1/1982
(Continued)

*Primary Examiner* — Timothy V Eley
(74) *Attorney, Agent, or Firm* — Andrew W. Chu; Craft Chu PLLC

(57) ABSTRACT

The device for polishing optical lenses includes a lens holder; a device for positioning the lens holder; and a device for rotating the lens holder about an axis. There is also a polishing tool; a tool holder; a device for positioning the tool holder; and a device for rotating the tool holder about an axis. The device for polishing also includes a ball joint arranged between a shaft secured to the tool holder and the device for positioning the tool holder, or between a shaft secured to the lens holder and the device for positioning the lens holder, so as to enable a spherical movement of the polishing tool and of the lens. The invention also relates to a method for polishing using the device according to the invention.

13 Claims, 3 Drawing Sheets

(51) Int. Cl.

| | |
|---|---|
| ***B24B 49/16*** | (2006.01) |
| ***B24B 13/02*** | (2006.01) |
| ***B24B 13/06*** | (2006.01) |

(56) References Cited

U.S. PATENT DOCUMENTS 3,552,899 A * 1/1971 Tagnon ..... B24B 13/02 451/323
3,732,647 A 5/1973 Stith
3,827,192 A * 8/1974 Ferrand ..... B24B 13/02 451/277
3,900,972 A * 8/1975 Rupp ..... B24B 13/02 451/270
4,956,944 A * 9/1990 Ando ..... G05B 19/4166 451/159
5,140,777 A * 8/1992 Ushiyama ..... B24B 49/02 451/10
5,421,770 A * 6/1995 Bobst ..... B24B 37/30 451/162
6,149,506 A * 11/2000 Duescher ..... B24B 1/00 451/178
6,712,670 B2 * 3/2004 de la Llera ..... B24B 49/16 451/11
7,066,794 B2 * 6/2006 Granziera ..... B24B 13/02 451/158
7,125,313 B2 * 10/2006 Zelenski ..... B24B 7/06 451/11
7,278,908 B2 * 10/2007 Urban ..... B24B 13/012 451/259
8,029,341 B2 * 10/2011 Belly ..... B24B 13/01 451/259
8,460,062 B2 * 6/2013 Schneider ..... B24B 13/0037 451/277
8,961,267 B2 * 2/2015 Monnoyeur ..... B24B 13/0031 451/10
8,979,618 B2 * 3/2015 Nowak ..... B24B 13/00 451/527
2005/0221721 A1 10/2005 Valle et al.
2009/0163118 A1 * 6/2009 Kuebler ..... B24D 13/142 451/42
2010/0159804 A1 * 6/2010 Sampurno ..... B24B 49/16 451/5
2015/0024663 A1 * 1/2015 Torikai ..... B24B 13/005 451/42

FOREIGN PATENT DOCUMENTS

EP 1473116 A1 11/2004
WO 2004037489 A2 5/2004

* cited by examiner

DEVICE FOR POLISHING OPTICAL LENSES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The invention is related to the field of the polishing of lenses.

It relates in particular to an improved device for polishing lenses.

In the manufacture of spectacle lenses, the polishing is particularly important. The aim is to obtain, on the one hand, a sufficient finish quality, in order to obtain an optical polish so as to achieve the transparency of the lens, or to eliminate defects in the surface condition during the preceding machining operation referred to as generation. The aim is, on the other hand, to achieve as accurately as possible the prescribed radii of curvature, so that the effective correction corresponds to the recommended correction, without deformation of the surface that has been generated.

2. Description of Related Art Including Information Disclosed Under 37 CFR 1.97 and 37 CFR 1.98.

A current system consists in laying the lens on a deformable (foam) surface and in causing the tool to evolve on the surface to be polished while causing the lens to rotate on itself. This results into a deformation of the support of the lens according to the shape of the lens itself, which means that depending on the place where one is located, the tool will more or less press the lens and therefore the polishing function will be different from one point to another, which results into a deformation.

US-2005/0221721 provides a device for polishing lenses, wherein the polishing tool is mounted on a tool holder secured to the end of a movable shaft rotating about its axis and movable in translation along its axis. The tool holder is in addition movable in rotation about a vertical axis passing close to the tool holder. As to the lens, it is held on a holding block secured to the end of a shaft movable in rotation about its axis, and in translation along its axis. This holding block is in addition movable in translation along a perpendicular horizontal axis. All these possibilities of movement permit any freedom of positioning the tool relative to the lens.

Nevertheless, the polishing is not regular enough, since the resting force of the tool on the lens is not identical in all positions.

SUMMARY OF THE INVENTION

The present invention pretends to cope with at least part of the aforementioned drawbacks and provides a solution that permits to improve the consistency of the resting pressure of the tool on the lens.

To this end, the invention relates to a device for polishing optical lenses, comprising a lens holder, means for positioning said lens holder and means for causing said lens holder to rotate about an axis, comprising in addition a polishing tool, a tool holder, means for positioning said tool holder and means for causing said tool holder to rotate about an axis. This device is particular in that it comprises in addition a ball joint arranged between a hinged shaft integral with the tool holder and the means for positioning said tool holder, or between a hinged shaft integral with the lens holder and the means for positioning said lens holder, so as to enable a spherical displacement of said tool or said lens, respectively. Such an arrangement permits to achieve displacements along the path of the shape of the surface of the lens to be polished.

According to further features:

- said device can include a ball joint arranged between a hinged shaft integral with the tool holder and the means for positioning said tool, so as to permit a spherical displacement of said tool on a sphere the radius of which is in the range of the length of said hinged shaft,
- said device can include in addition a ball joint arranged between a hinged shaft integral with the lens holder and the means for positioning said lens holder, so as to enable a spherical displacement of said lens on a sphere the radius of which is in the range of the length of said hinged shaft,
- said means for positioning the tool holder or the lens holder, respectively, can include a supporting shaft movable in rotation about its axis, said supporting shaft including at its end, said ball joint, and an eccentric casing integral with the supporting shaft, said eccentric casing including means for guiding the hinged axis, such an arrangement permits a particularly reliable guiding of the hinged axis,
- said guiding means can be configured capable of performing a reciprocating movement between a position close to the axis of rotation of the supporting shaft and a position away from said axis, thereby permitting to create sinusoidal circular paths,
- the tool holder can be provided with means for detecting the pressure exerted by the tool on the lens, and a control loop between the detection means and the positioning means, so as to permit a control of said pressure on all defined areas of the lens,
- said tool can be fixed to said tool holder through elastic means,
- said device can include a tool support fixed to said tool holder through said elastic means, and said tool is fixed to said tool support through a deformable part, thereby permitting to add to the known flexibility due to the deformable part additional flexibility due to the elastic means,
- said elastic means can be an elastic membrane; this membrane can be flat or have another shape,
- said tool holder can comprise a tight space containing gas adjacent to said elastic means, so that a force applied to said elastic means produces a change in volume of said space, thereby permitting to measure said force, for example by measuring the pressure of said gas.

The present invention also relates to a method for polishing optical lenses using a polishing device according to the invention, wherein said tool describes a path having a circular sinusoidal shape.

According to an advantageous embodiment of the invention, a full turn does not correspond to an integer number of periods of said path, so that the contact points between the tool and the lens are not identical between two consecutive turns.

According to another advantageous embodiment of the invention, said lens can comprise areas with different radii of curvature, so as to permit a usage as progressive vision lenses, and the combination of adjustments permits to keep the tool always perpendicular to the area of the surface to be polished.

The advantage resulting from the present invention resides in particular in that it permits to polish along paths ensuring a regular polishing across the entire surface of the lens to be polished. It permits in addition an adjustment at any time of the pressure of the tool on the lens, thereby ensuring a higher quality of polishing.

Further features and advantages of the invention will become clear from the following detailed description referring to an exemplary embodiment given by way of an indication and a non-restrictive example.

BRIEF DESCRIPTION OF THE DRAWINGS

The understanding of this description will be facilitated when referring to the attached drawings.

DETAILED DESCRIPTION OF THE DRAWINGS

Figure 1:
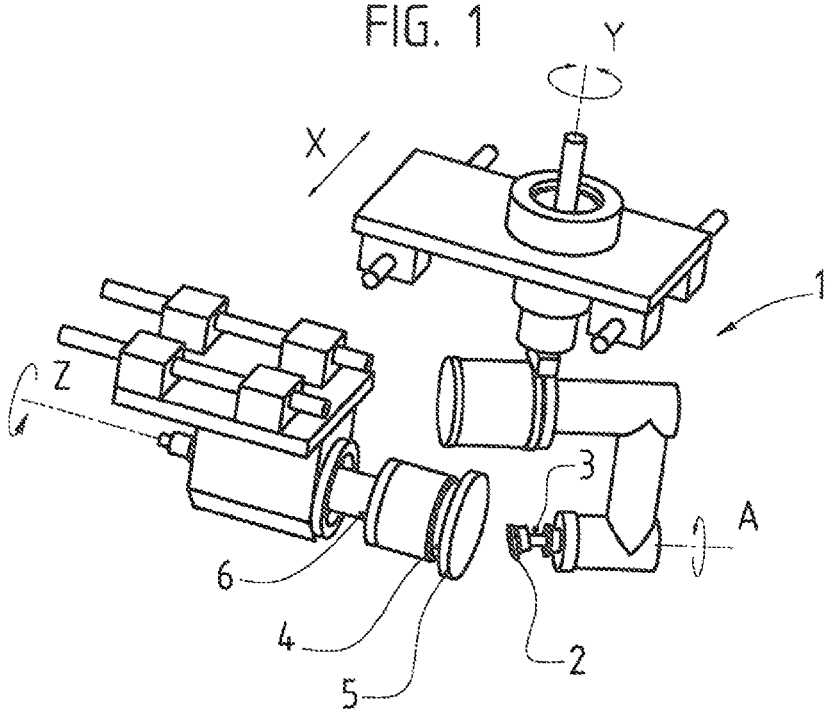
FIG. 1 represents a schematic perspective view of a device according to the state of the art.

As can be seen in FIG. 1, a device 1 for polishing lenses, according to the state of the art, comprises a tool 2, a tool holder 3 movable in rotation about its axis A, and movable in translation along said axis A. The assembly is also movable in rotation about a substantially vertical axis V, which axis V passes close to the tool holder 3, so that the rotational movement about the axis V does not produce any significant displacement of the tool, but only its rotation. The device 1 comprises in addition a lens holder 4 capable of holding a lens 5, and secured to the end of a shaft 6 movable in rotation about its axis Z, and movable in translation along said axis Z. The lens holder assembly and its shaft are also mobile in translation along an axis X perpendicular to the axis Z in the horizontal plane, so that the lens holder can move towards the tool or away from same, but also move sidewise relative to the tool.

Figure 2:
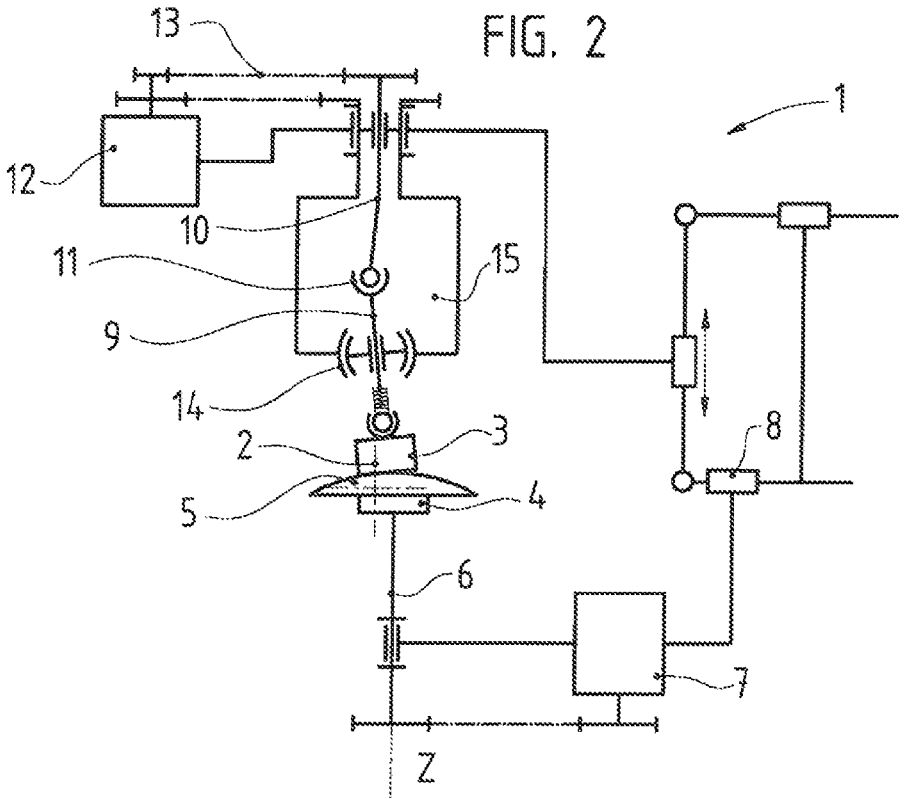
FIG. 2 represents a functional schematic view of a device according to the invention.
Figure 3:
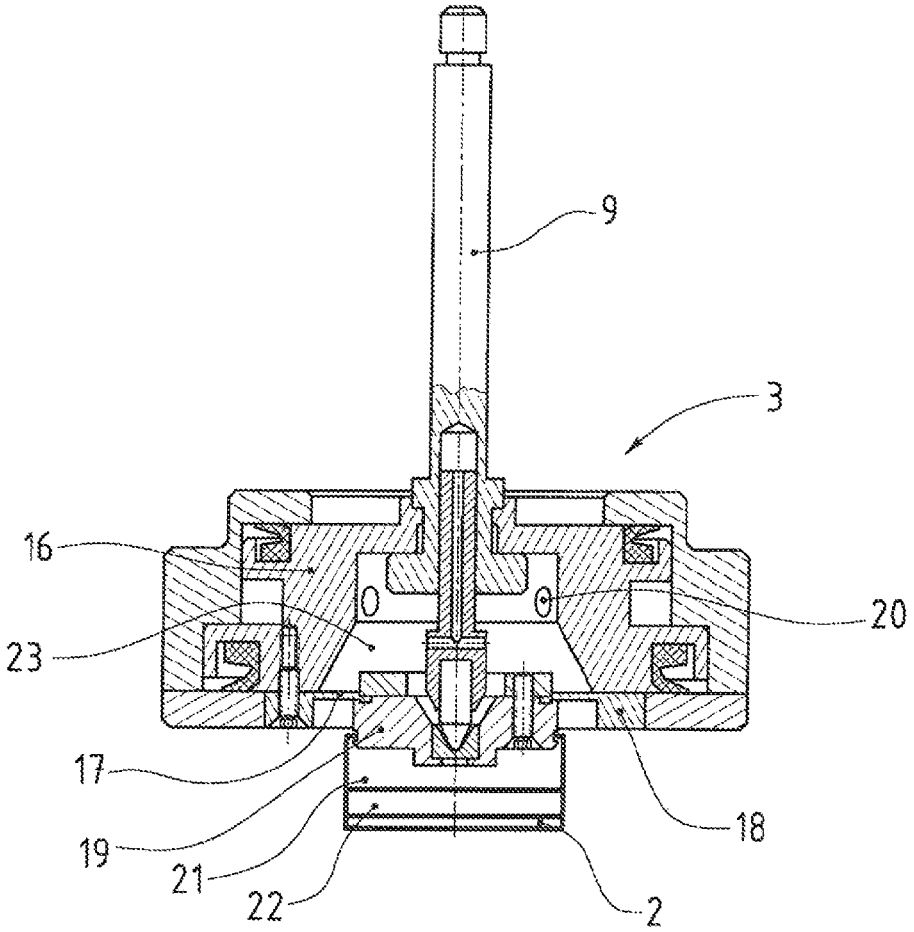
FIG. 3 represents a cross-sectional view of a tool holder of the device of FIG. 1.
Figure 4:
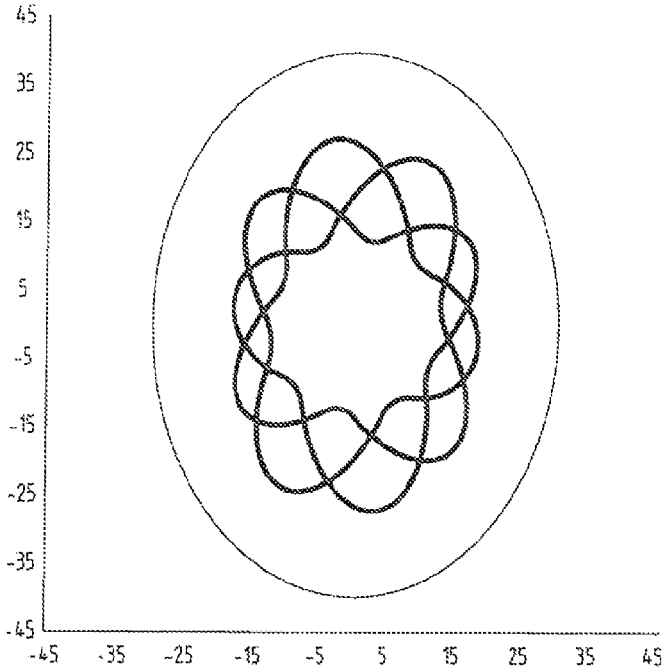
FIG. 4 represents a graph illustration showing an example of a path of the tool on the lens.

As shown in FIGS. 2 to 4 of the attached drawing, the present invention relates to a device 1 for polishing lenses. The lens 5 is arranged on a lens holder 4 secured to the end of a shaft 6, movable in rotation about its axis Z. A motor 7 is mechanically connected to the shaft 6 and capable of causing it to rotate. A translation device 8 permits to impart a horizontal translation motion to the assembly of lens holder 4 and shaft 6, so that the lens 5 can be moved horizontally while it is caused to rotate about the axis Z. According to a further embodiment, one can move the tool holder assembly instead of moving the lens.

A tool 2 is fixed on a tool holder 3. This tool holder includes a tool-support body 16, in which a space 23 is formed that can include a gas, for example air. An elastic membrane 17, for example a flat membrane, is fixed on the one hand to the tool-support body by means of a locking ring 18, on the other hand to the tool support 19. The latter is therefore movable relative to the tool-support body, so that the pressure exerted on the tool support by the polishing operation results into a reduction of volume inside the tool-support body, and therefore into an increase of the pressure. A pressure sensor 20 permits to measure this pressure change and to transmit the information to data-processing means such as an automate or a computer, which then controls a movement of the tool holder towards the lens, if the pressure has decreased, or a movement away from the lens when the pressure has increased.

The elastic membrane 17 permits furthermore to transmit the rotational torque of the tool-support body 16 to the tool support 19.

A connecting part 21 is inserted by pressure onto the tool support. This part is for example made of plastic material. A foam pad 22 is stuck on the connecting part 21, and the tool 2 is stuck to the pad 22. This tool 2 can adopt the shape of an abrasive polishing sheet. The pad is deformable, which permits an automatic orientation of the polishing sheet tangent to the lens. The elastic membrane enhances the flexibility of the tool.

The tool holder is secured to a hinged shaft 9 movable in rotation about its axis, and secured to a supporting shaft 10, which is here an upper shaft 10, through a ball joint 11. The upper shaft 10 is driven in rotation about its axis by a motor 12, a belt 13, or a chain ensuring the mechanical connection between said motor 12 and the upper shaft 10. The ball joint 11 enables the hinged shaft 9 to adopt an inclination with respect to the vertical line, designated by a in the continuation of this description, while transmitting the rotational motion of the upper shaft 9 to the hinged shaft 9, so that the hinged shaft 9 is driven in rotation about its axis. The inclination a of the hinged shaft 9 is controlled by a device 14 for horizontally displacing a point of the hinged shaft 9. Any other device for controlling the inclination could also be suitable. Preferably, a casing 15 is movable in rotation about a substantially vertical axis, and drives the device 14 for horizontal displacement in a rotational path about the axis of the upper shaft 10. The hinged shaft 9 can thus rotate not only about its axis, but also about the vertical axis of the upper shaft 10, so that the tool holder, while rotating on itself, describes a path about the vertical line, which can be circular if the device 14 for horizontal displacement maintains the hinged shaft in a fixed position with respect to the vertical line, but which can also describe a circular sinusoid, if the device 14 describes a reciprocating motion during the rotation of the casing 15.

The upper shaft 10 is herein referred to as "upper", and it is indeed located above the hinged shaft 9 in the embodiment of FIG. 2. But it could also be located next to, or under the hinged shaft 9. For the purposes of the present patent application, it will nevertheless be referred to as "upper shaft", although it can be located lower.

Figure 5:
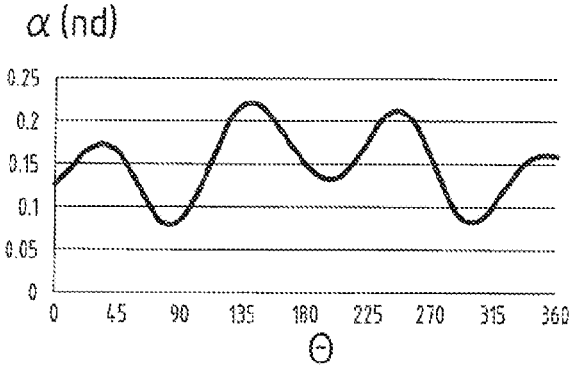
FIGS. 5 and 6 represent two graph illustrations showing an example of inclination of the tool holder around its ball joint, respectively of the corresponding displacement of the hinged shaft.
Figure 6:
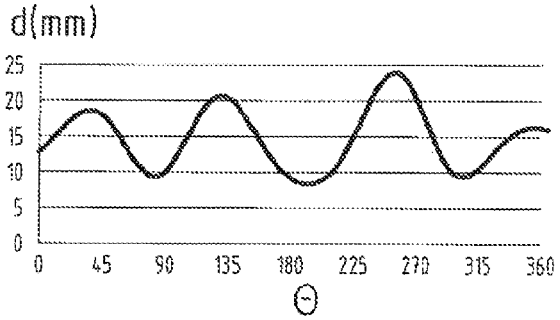

FIGS. 4 to 6 show such a movement, the tool describing a circle on this path. FIG. 5 shows the variation of the angle $\alpha$ depending on the angle of rotation $\theta$ on an entire turn (360°) about the vertical axis. FIG. 6 shows the variation of the distance d of the device 14 relative to the axis of the upper shaft depending on the angle of rotation $\theta$ on an entire turn (360°) about the vertical axis. These two curves are of the sinusoidal type in that the curve passes periodically above and below the abscissa axis. FIG. 4 shows the path obtained on the lens, of the circular sinusoidal type, in that the path passes periodically outside and inside a circle. The tool holder rotates on itself while describing this path. One should observe a phase shift between the reciprocating movement of the device 14, and the rotation about the vertical axis, producing a difference of path after each turn. In the example shown, the tool is located at the same point of the lens after three turns. It should also be noted, in the example shown, that the lens is not circular, but oval. The path obtained is adapted to this oval shape. This can for example be obtained through a coordinated horizontal movement of the lens. It should be noted that the shape of the lens can be any shape, the oval shape being only one example among many possible shapes.

According to another embodiment of the invention, the shaft 6 can be subdivided into a lower vertical supporting shaft and a hinged shaft, connected to the supporting shaft by a ball joint, in a way similar to the construction of the hinged shaft for the tool holder. Such an arrangement can facilitate the polishing of the convex lenses by reducing the vertical movements for adapting the tool holder, which must always be located accurately on the surface of the lens.

According to yet another embodiment, only the shaft supporting the lens holder is made of a vertical shaft and a hinged shaft, and the shaft supporting the tool holder is without such a ball joint. Such an arrangement does not depart from the scope of the invention. The word "vertical" is used here for simplicity of the description, but an arrangement in which said shaft would be inclined or even horizontal does not depart from the scope of the present invention.

Because of the ball joint or the two ball joints, several movements are combined and because of the combination of all these movements, there is an increase of the intersection of the polishing lines, which results into uniformity of the polishing and not into a deformation of the lens.

In addition, off-centering the tool in a path about the axis of rotation of the upper shaft permits to prevent the accumulation of polishing dust, which is always driven to one side or the other. Thus, the tool is always into direct contact with the lens, and performs an optimized polishing. Indeed, the accumulation of dust between the tool and the lens would reduce the quality of polishing, and can cause scratches on the lens.

The advantage of the present invention resides in particular in that it permits a polishing along paths ensuring a regular polishing over the entire surface of the lens to be polished. It allows in addition an adjustment at any time of the pressure of the tool on the lens, thereby guaranteeing a better quality of polishing, especially for soft materials such as "plastics".

What is claimed:

1. A device for polishing optical lenses, said device comprising:

a lens holder having a lens holder axis;

means for positioning said lens holder;

means for rotating said lens holder about said lens holder axis;

a tool holder having a tool holder axis;

a polishing tool attached to said tool holder;

means for positioning said tool holder;

means for rotating said tool holder about said tool holder axis; and a ball joint engaging at least one of a group consisting of said tool holder and said lens holder through a shaft, said tool holder having a range of spherical displacement relative to said lens holder, wherein said tool is fixed to said tool holder through an elastic means, and wherein said tool holder comprises an interior space having a volume, containing gas, adjacent to said elastic means, and wherein said volume of said interior space corresponds to a force applied on said elastic means.

2. The device according to claim 1, wherein said ball joint engages said tool holder, said shaft being connected to said means for positioning said tool holder.

3. The device according to claim 2, further comprising an additional ball joint engaging said lens holder by an additional shaft, said additional shaft being connected to said means for positioning said lens holder, said lens holder having a range of spherical displacement relative to said tool holder.

4. The device according to claim 1, wherein said means for positioning the tool holder comprises:

a supporting shaft having an end and being rotatable about a supporting shaft axis;

another ball joint on said end;

an eccentric casing integral with said supporting shaft; and means for guiding a hinged axis between said shaft and said supporting shaft, said means for guiding said hinged axis being mounted on said eccentric casing.

5. The device according to claim 4, wherein said means for guiding reciprocates between a position close to said supporting shaft axis and a position away from said supporting shaft axis.

6. The device according to claim 1, wherein the tool holder is comprised of means for detecting pressure exerted by the tool, and a control loop between the means for detecting and the means for positioning said tool holder, so as to enable a control of said pressure.

7. The device according to claim 1, wherein said elastic means drives said tool in rotation.

8. The device according to claim 1, further comprising a tool support fixed to said tool holder through said elastic means, said tool being secured to said tool support through a deformable part.

9. The device according to claim 1, wherein said elastic means is comprised of an elastic membrane.

10. A device for polishing optical lenses, said device comprising:

a lens holder having a lens holder axis;

means for positioning said lens holder;

means for rotating said lens holder about said lens holder axis;

a tool holder having a tool holder axis;

a polishing tool attached to said tool holder;

means for positioning said tool holder;

means for rotating said tool holder about said tool holder axis;

a shaft integral with said tool holder; and a ball joint between said shaft and said means for positioning said tool holder, said polishing tool having a range of spherical displacement corresponding to said ball joint, wherein said means for positioning said tool holder comprises:

a supporting shaft having an end and being rotatable about a supporting shaft axis;

a supporting ball joint on said end; and an eccentric casing integral with said supporting shaft; and means for guiding a hinged axis between said shaft and said supporting shaft, said means for guiding said hinged axis being mounted on said eccentric casing.

11. The device for polishing optical lenses, according to claim 10, wherein said means for guiding said hinged axis reciprocates between a position close to said supporting shaft axis and a position away from said supporting shaft axis.

12. A device for polishing optical lenses, comprising:

a lens holder;

means for positioning said lens holder;

means for rotating said lens holder about an axis;

a polishing tool;

a tool holder;

means for positioning said tool holder;

means for rotating said tool holder about an axis;

a shaft integral with said lens holder; and a ball joint between said shaft and said means for positioning said lens holder, said polishing tool having a range of spherical displacement corresponding to said ball joint, wherein said means for positioning said lens holder comprises:

a supporting shaft having an end and being rotatable about a supporting shaft axis;

a supporting ball joint on said end; and an eccentric casing integral with said supporting shaft; and means for guiding a hinged axis between said shaft and said supporting shaft, said means for guiding said hinged axis being mounted on said eccentric casing.

13. The device for polishing optical lenses, according to claim 12, wherein said means for guiding said hinged axis reciprocates between a position close to said supporting shaft axis and a position away from said supporting shaft axis.

* * * * *